United States Patent [19]

Shen

[11] Patent Number: 4,756,178

[45] Date of Patent: Jul. 12, 1988

[54] LOW FRICTION SUPER HEAVY-DUTY LEVER HANDLE LOCKSET

[76] Inventor: Richard Shen, No. 233, Sec. 2, Hai Tien Road, Tainan, Taiwan

[21] Appl. No.: 85,207

[22] Filed: Aug. 14, 1987

[51] Int. Cl.[4] ..... E05B 17/08

[52] U.S. Cl. ..... 70/380; 70/134; 292/169.23; 292/DIG. 57

[58] Field of Search ..... 292/169 R, 169.23, DIG. 57; 70/379 R, 380, 134

[56] References Cited

U.S. PATENT DOCUMENTS

| | | | |
|---|---|---|---|
| 1,876,079 | 9/1932 | Schlage | 292/169.23 |
| 2,953,405 | 9/1960 | Kubik | 292/169.23 |
| 4,418,949 | 12/1983 | Horgan | 292/DIG. 57 |

*Primary Examiner*—Robert L. Wolfe

*Attorney, Agent, or Firm*—Bacon & Thomas

[57] ABSTRACT

A lever type lockset with a rolling housing within a main housing. The roller housing normally only touches the main housing at the rollers and also connects to the latch portion of a lockset. The side plates of the roller are constructed separately from the roller housing so that they can be made thicker and more durable. The inner and outer spindle each have a curved elbow on it which is shaped somewhat like two boomerangs joined together on adjacent distal ends for minimizing local stress concentrations. The side plate also has a curved surface which is designed to offer minimal resistance to the elbows so that the handle can be turned with very little resistance.

1 Claim, 6 Drawing Sheets

LOW FRICTION SUPER HEAVY-DUTY LEVER HANDLE LOCKSET

BACKGROUND OF THE INVENTION

This invention relates to a low friction, heavy-duty lockset, and especially relates to a lever type lockset which employs a roller housing within the main housing thereof.

Previously, many lever type locksets have employed a slidable type housing (20) (for pulling a lockset) within a main housing (10), as shown in FIGS. 7 and 8. This type of structure has the drawback that there is a certain amount of unavoidable friction between the slidable housing (20) and the main housing (10). Ordinarily, this friction is of no major consequence. However, to a handicapped user this relatively small amount of friction (or resistance) might be enough to prevent the user from turning the handle.

A second problem with conventional lever type locksets can also be seen in FIGS. 7 and 8. Most spindles (30) have had small, rectangular cross-section protrusions (301) set thereon for forcing a slide plate (201) backwards and thereby pulling back a latch (not shown) so as to allow the door to be opened. However, since the force is applied at the distal radial end of the protrusion (301), there is a corresponding bending moment and shear force where the protrusion (302) meets the surface of the spindle (30). The bending moment and shear force, in turn, create a lot of stress at point (302). After many cycles of usage, the protrusion (301) can easily be broken due to fatigue failure.

A third problem with conventional lever type locksets is that the slide housing (20) therein was formed as one piece. However, in order to form as one piece, the thickness of the side plates (201) had to be reduced to facilitate manufacture thereof. This "reduced" thickness has in turn also caused stress and/or bending failures.

It is the purpose of this present invention, therefore, to mitigate and/or obviate the abovementioned drawbacks in the manner set forth in the detailed description of the preferred embodiment.

SUMMARY OF THE INVENTION

A primary objective of this invention is to provide a low-friction lockset with a roller housing therein for pulling a corresponding lockset.

Another objective of this invention is to provide a low-friction lockset with an improved method for pushing back a side plate by a spindle.

A further objective of this invention is to provide a low-friction lockset with a highly durable inner spindle.

Still another objective of this invention is to provide a low-friction lockset in which the roller housing is composed of an inner body and of side plates so as to strengthen it.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
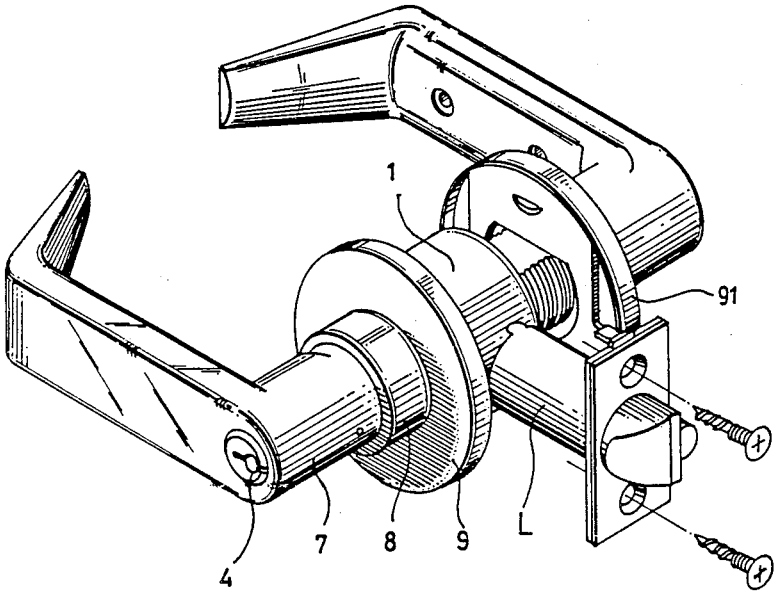
FIG. 1 is a working view of a low friction, heavy-duty lockset in accordance with the present invention.
Figure 2:
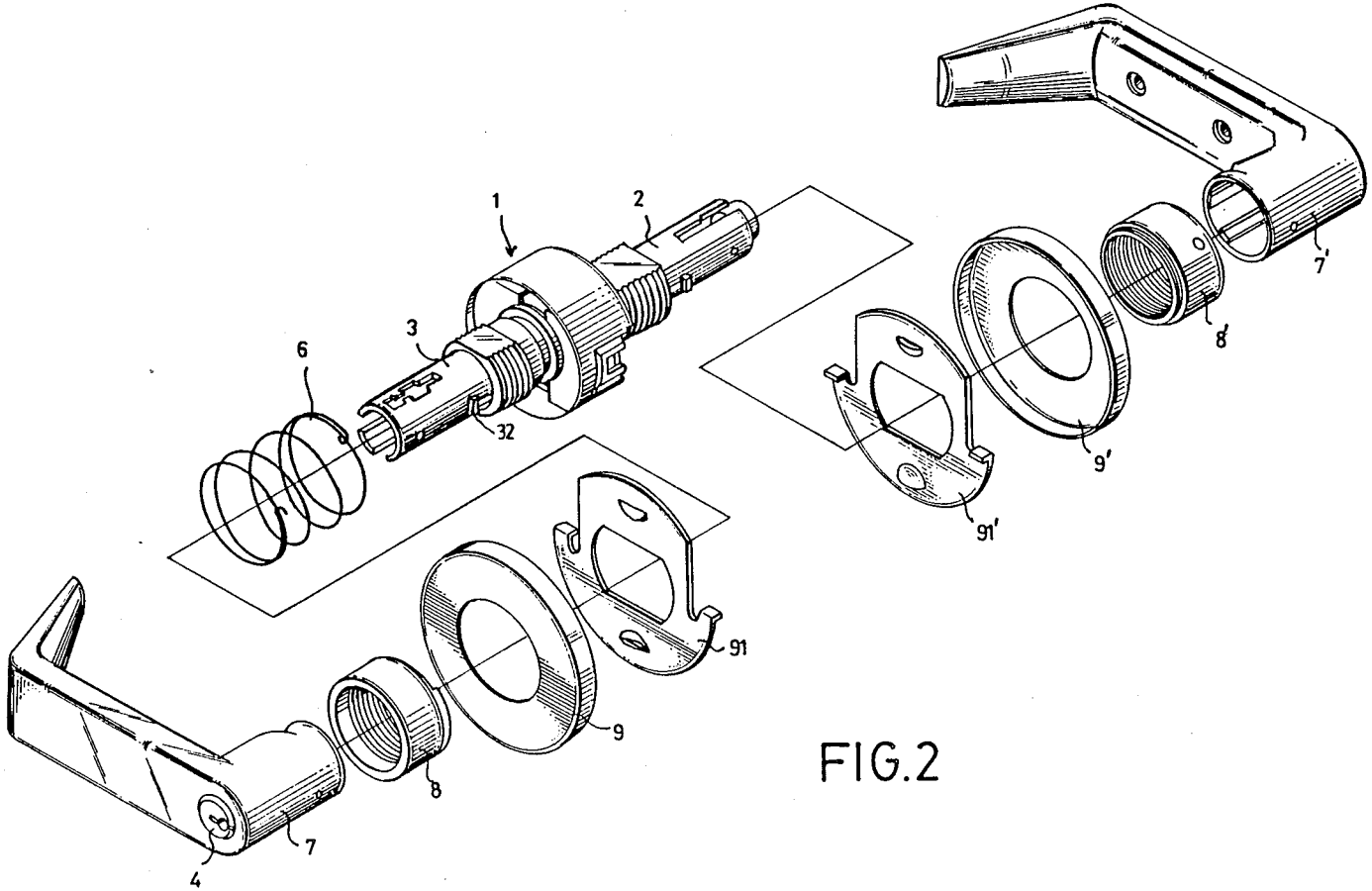
FIG. 2 is an exploded view of a heavy duty lockset in accordance with the present invention.

Referring to FIG. 1, it can be understood that the present invention is used in conjunction with a conventional lever handle type door latch assembly comprising an lever type handle 7 with a keyway 4, a spindle casing 1, escutcheons 9 and 9', and cover rings 8 and 8'. In FIGS. 2, the above mentioned parts, in addition with outer plates 91, a torsional spring 6, and inner and outer spindles 3 and 2, respectively, can be seen. It is noted that the present invention substantially consists of the portion including the spindle casing 1 and the inner and outer spindle, 3 and 2, respectively, of the present disclosure. The other parts shown herein are shown only as complementary parts to the present invention.

Figure 3:
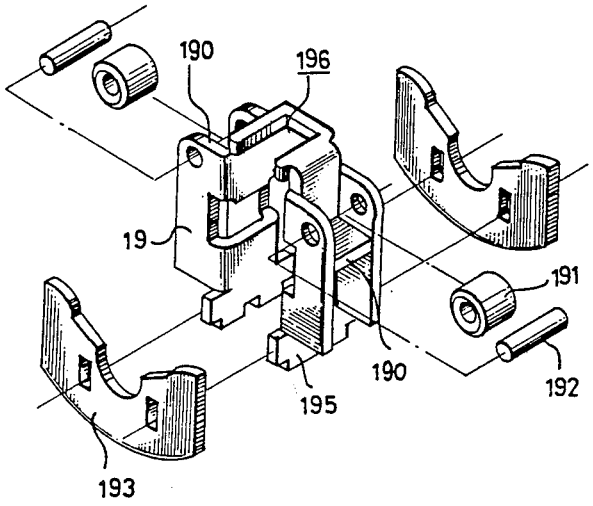
FIG. 3 is an exploded view of a roller housing in accordance with the present invention.
Figure 4:
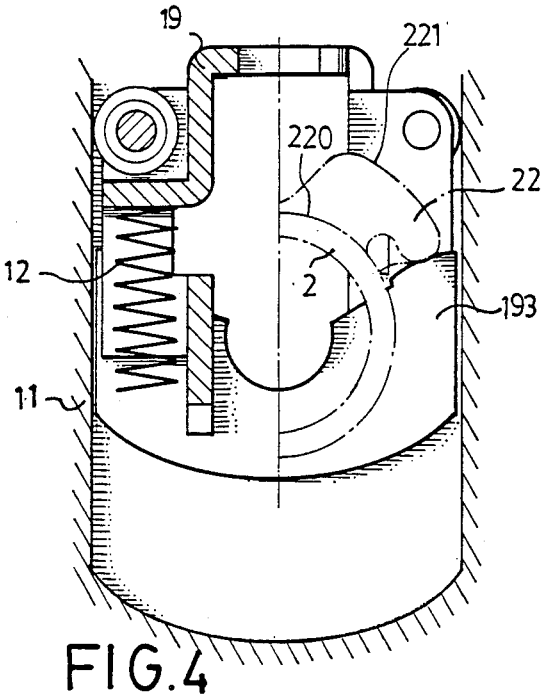
FIG. 4 is a partially cutaway view of a roller housing in accordance with the present invention with lever handle in normal (non-use) position.
Figure 5:
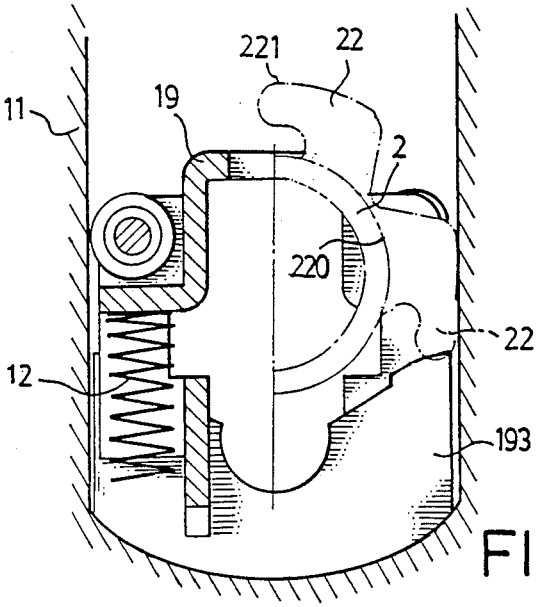
FIG. 5 is a partially cutaway view of a roller housing in accordance with the present invention after the lever handle has been turned.
Figure 7:
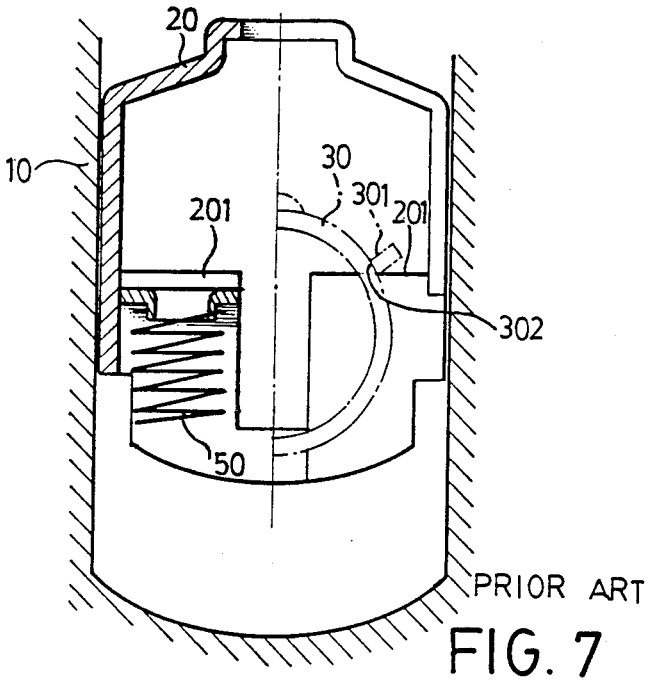
FIG. 7 is a partially cutaway view of the prior art slide housing with the lever handle in normal (non-use) position.
Figure 8:
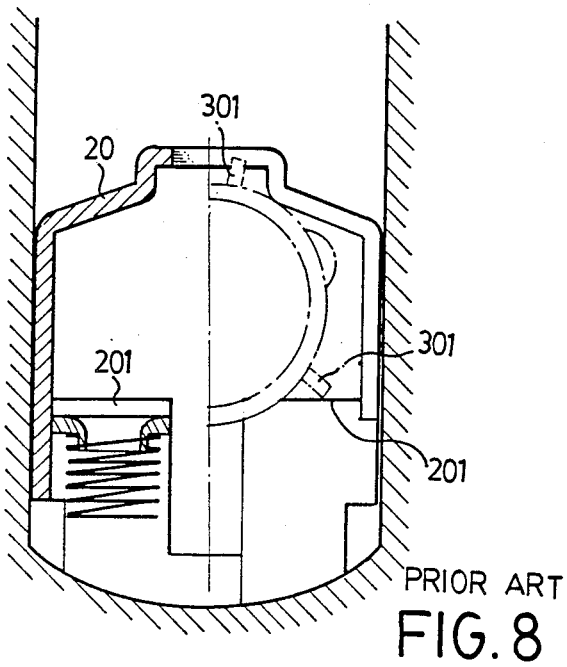
FIG. 8 is a partially cutaway view of the prior art slide housing with the lever handle after the lever handle has been turned.

FIGS. 3, 4, and 5 show various views of the roller housing 19 of the present invention. The roller housing comprises two wings 190. From FIG. 3, the detailed structure of the roller housing 19 and its components can be seen. Each of the two wings 190 has two holes on either upper side thereof for receiving corresponding roller axles 192, and their respective rollers 191, therein. A respective side plate 193 fits on either side of the roller housing 19 and is fixed thereto by means of protrusions on the fixing base 195 fitting into corresponding holes on the side plates 193. The side plates 193 are manufactured separately from the main body of the roller housing 19 so that the walls of the side plates 193 can be made thicker and stronger than would be possible if manufactured as a single unit. Also, the walls of the side plates 193 are thicker than the walls of the wings 190, for greater overall durability of the door latch. As can also be seen from FIG. 3, the body of the roller housing 19 has a lockset engagement slot 196 in the top center portion thereof for engaging with a lockset "L" (see FIG. 1).

FIG. 4 shows the roller housing 19 of the present invention. Note that rollers are only needed on one end of the roller housing 19 because the lockset "L" (see FIG. 1) grips the lockset engagement slot 196 so as to balance the roller housing 19 in the cavity of the main housing 11. Therefore the only part of the roller housing 19 which touches the side walls of the main housing 11 are the rollers themselves 191, which are in rollable contact with the respective side walls of the main housing 11. This makes possible substantially frictionless displacement of said roller housing 19.

Figure 6:
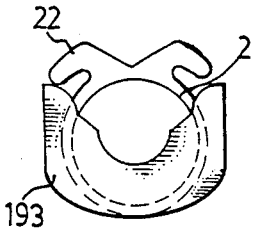
FIG. 6 is an elevational view of an inner spindle with elbows thereon set against a side plate, in accordance with the present invention.

Still referring to FIG. 4, the elbow 22 of the inner spindle 2 can be seen. The elbow 22 of the present invention has a long contact surface 220 with the inner spindle 2, thereby eliminating problems due to local stress points mentioned in the Background of the Invention. In addition, because of the curved nature of the elbow 22 and the side plate 193, the elbow 22 smoothly urges the side plate 193, and hence the whole roller housing 19, downwards. However, as mentioned before, there is very little resistance to movement of the roller housing 19 since only the rollers 196 actually touch the side walls of the main housing 11. In FIG. 6, a view of the inner spindle 3 and the side plate 193 can be seen (not showing the rest of the roller housing 19). This view clearly illustrates that in normal (non-use) position the distal ends of the elbows 22 touch the top portions of the side plate 193, so that the lever type handle could be turned in either CW or CCW with equal effectiveness. The elbow 38 on the inner spindle 3 (see FIG. 9) is identical in shape and function with the elbow 22 on the outer spindle 2. Each of the elbows, 38 and 22, have a respective inner surface, 381 and 220, which forms an integral piece with an outer circular sector of respective inner outer spindles (3 and 2). The elbows (38 and 22) also each have two boomerang-like outer surfaces which are joined together proximate to a central portion of said inner surface. In addition, the outer surfaces all have smoothly curved contours for providing further ease and smoothness when turning the lever type handle 7.

Figure 9:
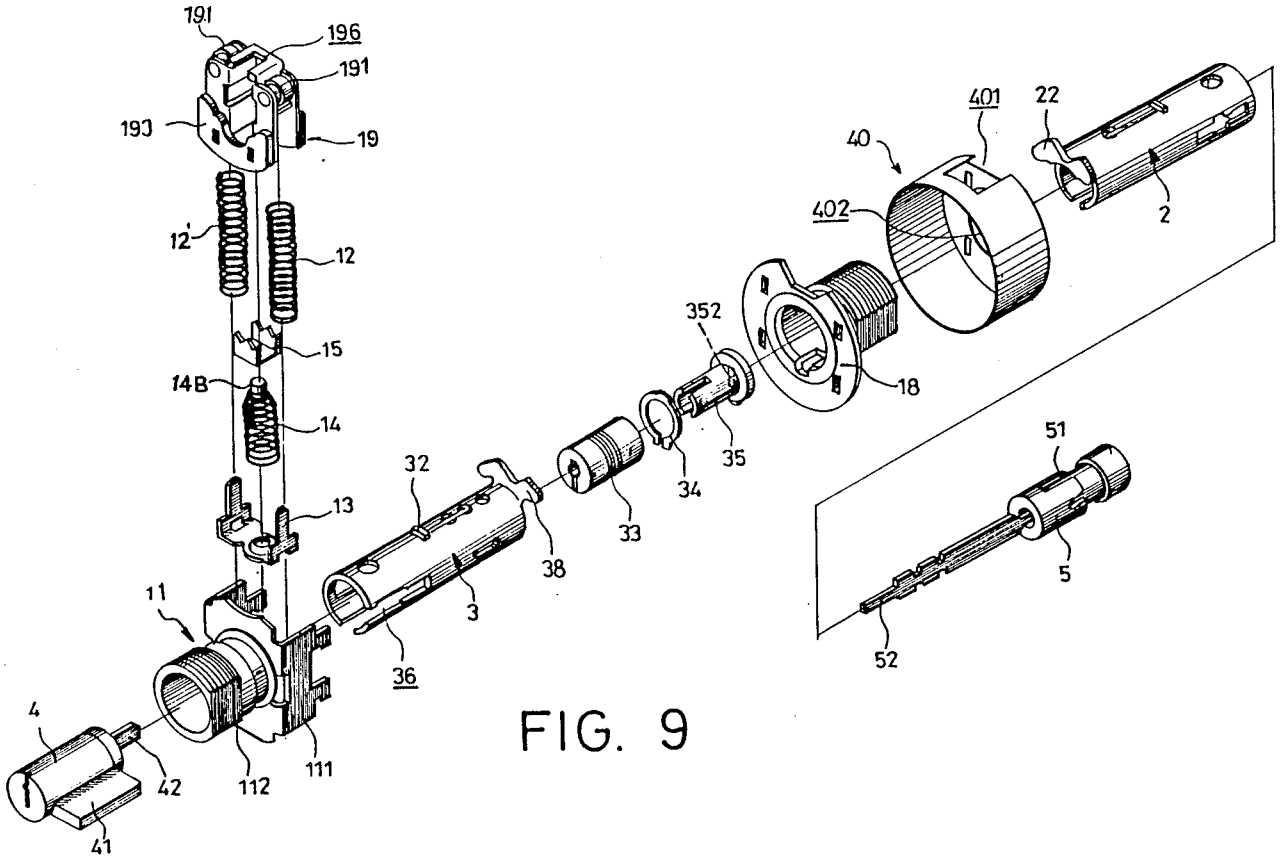
FIG. 9 is an exploded view of a low friction heavy-duty lockset in accordance with the present invention.

Referring to FIG. 9, the overall inner structure of the present invention, including its complementary parts, can be seen. The main housing 11 slidably receives the roller housing 19, along with outer springs 12 and 12' and central spring 14A with plug 14B and fixing bracket 15 thereon. All of the above springs fit are received by the spring bracket 13, which fits into the main housing 11. The main housing 11 also receives a keyway 4 on one side thereof and the inner spindle 3 on the other side thereof. The keyway 4 also telescopes into the inner spindle 3. The block 41 of the keyway 4 is slidably received into the inner spindle 3. The keyway 4 and the other parts shown which are along the horizontal line have the same function and mode of operation as the prior art and hence will not be discussed in further detail.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. In an lever handle type door latch with a keyway (4) coordinated with a main housing (11), inner and outer spindles (3 and 2), and other complementary parts, the improvement comprising:

(A) respective identical elbows (38 and 22) on said inner and outer spindles (3 and 2); said elbows (38 and 22) each having a respective inner surface (381 and 220) which forms an integral piece with an outer circular sector of respective said inner and outer spindles (3 and 2); said elbows (38 and 22) also each having two boomerang-like outer surfaces which are joined together proximate to a central portion of said inner surface; said outer surfaces (381 and 220) having smoothly curved contours;

(B) a roller housing (19) including two wings (190), a lockset engagement slot (196), and two side plates (193); each of said wings (190) having two holes thereon for receiving a roller axle (192) and a corresponding roller (191); said rollers (191) rollably contacting respective side walls of said main housing (11) for sustantially frictionless displacement of said roller housing (19); said side plates (193) having walls which are thicker than walls of said wings (190); said side plates (193) being fixable to a fixing base (195) of said roller housing (19).

* * * * *